US011320223B2

(12) United States Patent
Pokalyaev et al.

(10) Patent No.: US 11,320,223 B2
(45) Date of Patent: May 3, 2022

(54) AUTOMATIC FIREARM HAVING AN INERTIAL AUTOMATION SYSTEM

(71) Applicants: Vasilij Mihajlovich Pokalyaev, Sverdlovskaya obl. (RU); Sergei Pokalyaev, g. Kachkanar (RU)

(72) Inventors: Vasilij Mihajlovich Pokalyaev, Sverdlovskaya obl. (RU); Sergei Pokalyaev, g. Kachkanar (RU)

( * ) Notice: Subject to any disclaimer, the term of this patent is extended or adjusted under 35 U.S.C. 154(b) by 0 days.

(21) Appl. No.: 17/281,967

(22) PCT Filed: Jun. 21, 2019

(86) PCT No.: PCT/RU2019/000446
§ 371 (c)(1),
(2) Date: Mar. 31, 2021

(87) PCT Pub. No.: WO2020/085942
PCT Pub. Date: Apr. 30, 2020

(65) Prior Publication Data

US 2021/0372720 A1 Dec. 2, 2021

(30) Foreign Application Priority Data

Oct. 22, 2018 (RU) ..... 2018137085

(51) Int. Cl.
*F41A 3/82* (2006.01)
*F41A 3/54* (2006.01)
*F41A 5/02* (2006.01)

(52) U.S. Cl.
CPC *F41A 3/82* (2013.01); *F41A 3/54* (2013.01); *F41A 5/02* (2013.01)

(58) Field of Classification Search
CPC ..... F41A 3/14; F41A 3/20; F41A 3/78; F41A 3/82; F41A 5/02
See application file for complete search history.

(56) References Cited

U.S. PATENT DOCUMENTS 4,142,314 A * 3/1979 Foote ..... F41A 3/82 42/16
4,416,186 A * 11/1983 Sullivan ..... F41A 3/26 89/198
5,983,549 A 11/1999 Battaglia
2006/0266209 A1 11/2006 Grabowski
(Continued)

FOREIGN PATENT DOCUMENTS

RU 2144171 C1 1/2000
RU 93516 U1 4/2010
RU 2626771 C2 8/2017

*Primary Examiner* — J. Woodrow Eldred
(74) *Attorney, Agent, or Firm* — John Alumit

(57) ABSTRACT

The invention relates to mechanisms for cocking an automatic weapon. An automatic firearm having an inertial automation system comprises a breech, a barrel, a bolt support with a bolt, a recoil spring and a return spring, a trigger mechanism, an ammunition supply mechanism and a bolt support latch. The latch fixes the bolt support in a rear position and is controlled with a trigger. A shot is produced at the instant the bolt support arrives in a front position. A mechanism for supplying cartridges to a cartridge chamber makes it possible to load the weapon when the bolt support is fixed in the rear position. Stable operation of an inertial automation system is achieved.

2 Claims, 1 Drawing Sheet

(56) References Cited

U.S. PATENT DOCUMENTS

| | | | | |
|---|---|---|---|---|
| 2014/0230642 | A1* | 8/2014 | Reynolds | F41A 3/78<br>89/130 |
| 2016/0047611 | A1* | 2/2016 | Battaglia | F41A 3/36<br>42/16 |

* cited by examiner

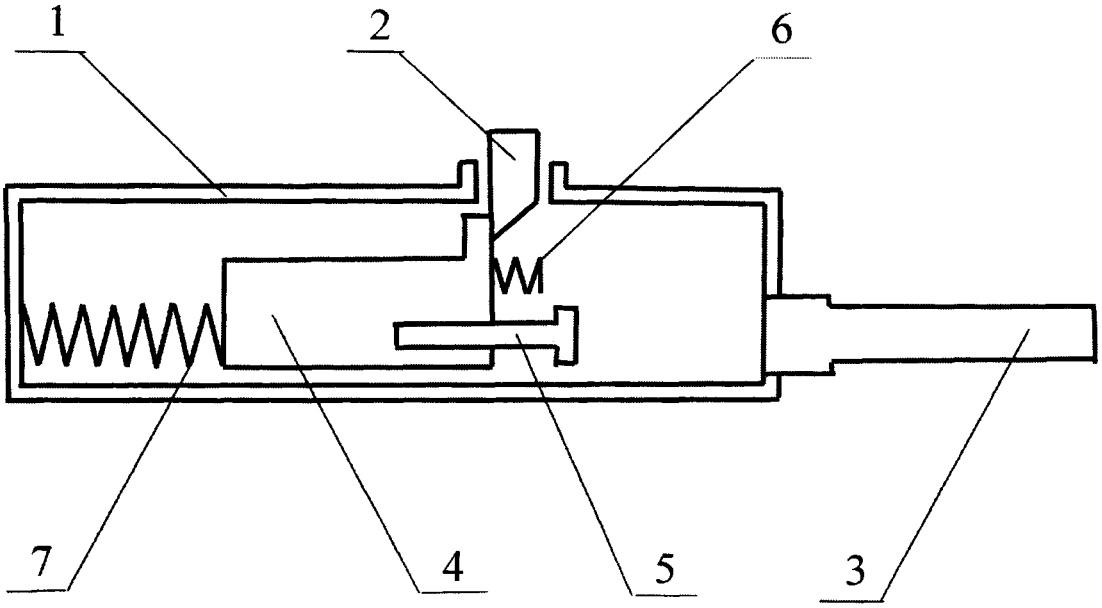
1
2
6
7
4
5
3

AUTOMATIC FIREARM HAVING AN INERTIAL AUTOMATION SYSTEM

This invention comes under the sphere of the military equipment namely the automatic (self-loading) firearms [F41C7/00, F41C3/00, F41A21/00].

Among currently existent equipment, we know a self-loading rifle with inertia automatics designed by Karl Sjogren (N739,732 PATENTED Sep. 22, 1903. O.A.T. SJOGREN. AUTOMATIC GAN. AFFLICATION FILED Jul. 13, 1901.).

A rifle with inertia automatics consists of a firing mechanism housing, barrel, massive bolt support, bumper spring between the bolt support and the rear wall of the firing mechanism housing, trigger and firing mechanism, ammunition feed mechanism, stock, sighting equipment.

Operation Principle of a Rifle:

The bolt support is forced backward, trigger and firing mechanism is cocked, the mainspring is compressed, the bolt support moves forward, cartridge is fed, the bolt moves home, the trigger is pressed to make shot and under the force of recoil the rifle moves back, the front wall of the firing mechanism housing collides with the bolt support through the bumper spring and under impulse the bolt support moves back, the bolt is unlocked and fired cartridge is released, the trigger and firing mechanism is cocked, the mainspring is compressed, the mainspring starts moving from the rear position and pushes the bolt support forward, the cartridge is fed, the bolt moves home, now the rifle is ready for the next shot.

Disadvantage of this design is unreliable, unstable functioning of the automatics.

The purpose of this invention is creation of the design of automatics for (self-loading) firearms with inertia automatics, which will be capable to provide stable and reliable functioning of automatics.

The engineering result supported with the provided set of features is creation of the firearm design capable to ensure stable and reliable functioning of the inertia automatics due to increased operation speed of automatics and increased extraction of recoil energy.

This task is resolved and engineering result is ensured due to embedding of the firing mechanism housing, barrel, bolt support, bumper spring between the bolt support and the front wall of the firing mechanism housing or barrel or bolt, the mainspring between the bolt support and the rear wall of the firing mechanism housing or another part, trigger and firing mechanism, ammunition feed mechanism, the clip latch aimed to fix the bolt support in the backward position (the clip latch is controlled with the trigger guard), mechanism for matching instant of firing with the moment, when the bolt support approaches to the forward position (immediately prior to collision with the front wall of the firing mechanism housing or barrel or bolt through the bumper spring), cartridge feed mechanism and mechanism for closing bolt, when the bolt support is fixed immovable in the backward position (variant, when automatics functions in self-loading regimen).

The firearm functions as follows:

The bolt support is forced backward, trigger and firing mechanism shall be cocked, the mainspring is compressed; the bolt support is fixed in backward position, the trigger is pressed to make shot, the clip latch releases the bolt support, the bolt support starts moving forward, the cartridge is fed, the bolt is locked immediately before collision of the bolt support with the front wall of the firing mechanism housing or barrel or bolt and automatics makes shot; under the recoil force the arm moves backward, the bolt support collides with the front wall of the firing mechanism housing or barrel or bolt through the bumper spring and due to the additional impulse the bolt support moves backward, the bolt unlocks and the fired cartridge is discharged, firing mechanism is cocked, the mainspring is compressed; when the firearm operates in self-loading regimen the bolt support is fixed in backward position; when the firearm operates in automatic regimen, if the trigger stays in pressed position and therefore the clip latch does not stop the bolt support in backward position, the operations of the mechanism will be repeated and automatic fire will be continuous until the bolt support will be fixed with the clip latch or ammunition will finish. When the ammunition-feed mechanism functions in self-loading regimen, when the bolt is fixed immovable in backward position, no any additional actions are done, when the bolt support moves forward due to what firing accuracy is improved.

As an example, the FIGURE demonstrates the design with the bumper spring between the bolt support and the front wall of the firing mechanism housing and the mainspring between the bolt support and rear wall of the firing mechanism housing.

The invention is illustrated with the drawing (see FIG. 1). The firing mechanism housing (pos. 1) includes the clip latch (pos. 2), barrel (pos. 3), bolt support (pos. 4) with bolt (pos. 5). There is the bumper spring (pos. 6) fixed to the bolt support. There is the mainspring (pos. 7) installed between the bolt support and back wall of the firing mechanism housing. The operation principle of the design is similar to that described above.

The invention claimed is:

1. An automatic, self-loading firearm an inertia-driven system comprising a firing mechanism housing (1), a barrel (3), a bolt support (4) with a bolt (5), a bumper spring (6) disposed between the bolt support (4) and a front wall of the firing mechanism housing (1), between the bolt support (4) and the barrel (3), or between the bolt support (4) and the bolt (4), a mainspring (7) disposed between the bolt support (4) and a rear wall of the firing mechanism housing (1), and a clip latch controllable by a trigger guard of the firearm for fixation of the bolt support in a backward position, WHEREIN the bolt support (4) is forced backward when a trigger of the firearm is cocked, which also compresses the mainspring (7) and causes it to bounce forward, prompting the bolt support (4) to move forward to feed a cartridge and place the bolt (5) in its original position, and when the trigger is activated to make a shot, the bolt support (4) collides with the front wall of the firing mechanism housing (1) via the bumper spring (6), said bumper spring forces the bolt support (4) to bounce backwards which unlocks the bolt (5) that releases the fired cartridge, causing the trigger to be cocked, and compressing the mainspring (7); said compressed mainspring (7) bounces forward pushing the bolt support (4) forward to feed a second cartridge and restoring the bolt (5) to its original position and ready for another shot.

2. The automatic, self-loading firearm of claim 1, further comprising a cartridge feed mechanism and a bolt locking mechanism, and wherein the bolt support is fixed immovable in a backward position.

* * * * *